US005786300A

United States Patent [19]

Bowman et al.

[11] Patent Number: 5,786,300

[45] Date of Patent: Jul. 28, 1998

[54] ASSEMBLAGE FOR THERMAL DYE TRANSFER

[75] Inventors: Wayne A. Bowman, Walworth; Robert A. Guistina; Kristine B. Lawrence, both of Rochester, all of N.Y.

[73] Assignee: Eastman Kodak Company, Rochester, N.Y.

[21] Appl. No.: 878,924

[22] Filed: Jun. 19, 1997

[51] Int. Cl.[6] ..... B41M 5/035; B41M 5/38

[52] U.S. Cl. ..... 503/227; 428/195; 428/500; 428/913; 428/914

[58] Field of Search ..... 8/471; 428/195, 428/500, 913, 914; 503/227

[56] References Cited

U.S. PATENT DOCUMENTS

| | | | |
|---|---|---|---|
| 4,668,560 | 5/1987 | Kobayashi et al. | 503/227 |
| 5,523,274 | 6/1996 | Shuttleworth et al. | 503/227 |
| 5,627,128 | 5/1997 | Bowman et al. | 503/227 |

*Primary Examiner*—Bruce H. Hess
*Attorney, Agent, or Firm*—Harold E. Cole

[57] ABSTRACT

A thermal dye transfer assemblage comprising:

(I) a dye-donor element comprising a support having thereon sequentially repeating dye layer patches of a dye dispersed in a polymeric binder, at least one of the dye patches containing a deprotonated cationic dye which is capable of being reprotonated to a cationic dye having a N-H group which is part of a conjugated system; and (II) a dye-receiving element comprising a support having thereon a polymeric dye image-receiving layer comprising a polymer having a Tg of less than about 9° C. and being of no or only slight acidity and a hydrated transition metal or metalloid salt of a strong acid, the dye-receiving element being in a superposed relationship with the dye-donor element so that the dye layer is in contact with the polymeric dye image-receiving layer.

12 Claims, No Drawings

ASSEMBLAGE FOR THERMAL DYE TRANSFER

CROSS REFERENCE TO RELATED APPLICATIONS

Reference is made to commonly-assigned U.S. patent application Ser. Nos. 08/878,717, filed concurrently herewith, entitled "Thermal Dye Transfer Assemblage With Low Tg Polymeric Receiver Mixture" by Harrison et al; 08/878,951, filed concurrently herewith, entitled "Thermal Dye Transfer Assemblage With Low Tg Polymeric Receiver Mixture" by Kung et al, 08/878,564, filed concurrently herewith, entitled "Thermal Dye Transfer Assemblage" by Evans et al, 08/879,061, filed concurrently herewith, entitled "Assemblage for Thermal Dye Transfer" by Guistina et al, 08/878,704, filed concurrently herewith, entitled "Assemblage for Thermal Dye Transfer" by Evans et al; and 08/878,565, filed concurrently herewith, entitled "Thermal Dye Transfer Assemblage With Low Tg Polymeric Receiver Mixture" by Lawrence et al, the teachings of which are incorporated herein by reference.

FIELD OF THE INVENTION

This invention relates to a thermal dye transfer assemblage wherein the receiver element contains a low Tg polymer and an acidic metal salt and the dye-donor element contains a deprotonated cationic dye.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye receiver polymer should have good affinity for the dye and provide a stable (to heat and light) environment for the dye after transfer. In particular, the transferred dye image should be resistant to image degradation by contact with other surfaces, chemicals, fingerprints, etc. Such image degradation is often the result of continued migration of the transferred dyes after the printing step.

Commonly-used dyes are nonionic in character because of the easy thermal transfer achievable with this type of compound. The dye-receiver layer usually comprises an organic polymer with polar groups to accept the dyes transferred to it. A disadvantage of such a system is that, since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two. However, this technique involves the transfer of a cationic species which, in general, is less efficient than the transfer of a nonionic species.

DESCRIPTION OF RELATED ART

U.S. Pat. No. 5,523,274 relates to the transfer of a deprotonated cationic dye to a dye image-receiving layer containing an organic acid moiety as part of an acrylic ester polymer chain having a Tg of less than 25° C. which is capable of reprotonating the deprotonated cationic dye. There is no disclosure in this patent that describes the use of mixtures comprising a metal salt capable of reprotonating the deprotonated cationic dyes and a polymer having no or only slight acidity. In addition, there is a problem with the polymers used in this patent in that they contain strong acids which catalyze the hydrolysis of acrylic esters which changes the properties of the polymer making it more hygroscopic and tacky.

U.S. Pat. No. 5,627,128 relates to the transfer of a deprotonated cationic dye to a polymeric dye image-receiving layer comprising a mixture of an organic polymeric or oligomeric acid which is capable of reprotonating the deprotonated cationic dye and a polymer having a Tg of less than about 19° C. and having no or only slight acidity. There is a problem with this system in that the rate of reprotonation of the deprotonated cationic dyes is slow, which produces noticeable hue shifts after a print is generated. In addition, there is no disclosure in this patent that describes the use of hydrated transition metal or metalloid salts of strong acids in the receiver to reprotonate the deprotonated cationic dyes.

U.S. Pat. No. 4,668,560 relates to a receiver element which contains a metal compound derived from metal salts of organic acids. However, there is a problem with this type of receiver element in that it does not reprotonate a deprotonated cationic dye transferred to it.

It is an object of this invention to provide a thermal dye transfer assemblage comprising an acidic dye-receiver which will reprotonate a deprotonated cationic dye transferred to it. It is another object of this invention to provide a thermal dye transfer assemblage which contains in its dye-receiving layer a polymer which shows an improved rate of dye protonation (% dye conversion).

SUMMARY OF THE INVENTION

These and other objects are achieved in accordance with this invention which relates to a thermal dye transfer assemblage comprising:

(I) a dye-donor element comprising a support having thereon sequentially repeating dye layer patches of a dye dispersed in a polymeric binder, at least one of the dye patches containing a deprotonated cationic dye which is capable of being reprotonated to a cationic dye having a N-H group which is part of a conjugated system; and (II) a dye-receiving element comprising a support having thereon a polymeric dye image-receiving layer comprising a polymer having a Tg of less than about 9° C. and being of no or only slight acidity and a hydrated transition metal or metalloid salt of a strong acid, the dye-receiving element being in a superposed relationship with the dye-donor element so that the dye layer is in contact with the polymeric dye image-receiving layer.

DESCRIPTION OF THE PREFERRED EMBODIMENTS

Deprotonated cationic dyes useful in the invention which are capable of being reprotonated to a cationic dye having a N-H group which is part of a conjugated system are described in U.S. Pat. No. 5,523,274, the disclosure of which is hereby incorporated by reference.

In a preferred embodiment of the invention, the deprotonated cationic dye employed in the invention and the corresponding cationic dye having a N-H group which is part of a conjugated system have the following structures:

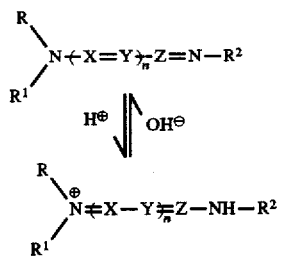

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents a substituted or unsubstituted phenyl or naphthyl group or a substituted or unsubstituted alkyl group from about 1 to about 10 carbon atoms; and n is an integer of from 0 to 11.

The deprotonated cationic dyes according to the above formula are disclosed in U.S. Pat. Nos. 4,880,769, 4,137,042 and 5,559,076, and in K. Venkataraman ed., *The Chemistry of Synthetic Dyes*, Vol. IV, p. 161, Academic Press, 1971, the disclosures of which are hereby incorporated by reference. Specific examples of such dyes include the following (the λ max values and color descriptions in parentheses refer to the dye in its protonated form):

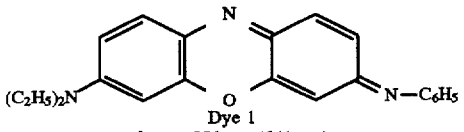

Dye 1
λ max 556 nm (641 nm)
magenta (cyan)
U.S. Pat. No. 4,880,769 (Dye 1)

-continued

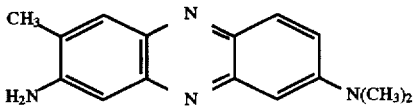

Dye 2
λ max 459 nm (536 nm)
yellow (magenta)

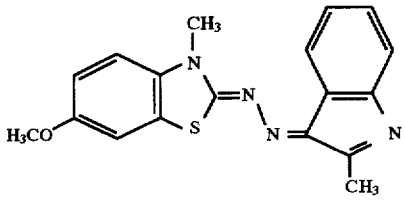

Dye 3
λ max 459 nm (522 nm)
yellow (megenta)

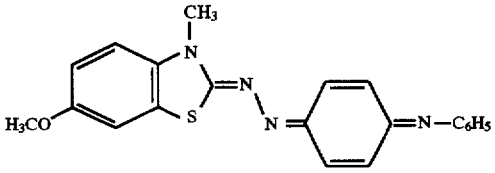

Dye 4
λ max 503 nm (621 nm)
red (blue)

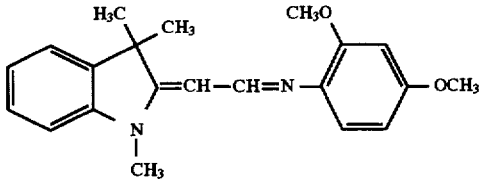

Dye 5
λ max 379 nm (405 nm)
yellow (yellow)

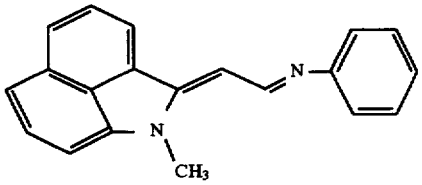

Dye 6
λ max 479 nm (513 nm)
yellow (magenta)

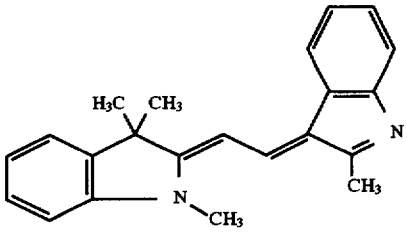

Dye 7
λ max 485 nm (495)
yellow (yellow)

-continued

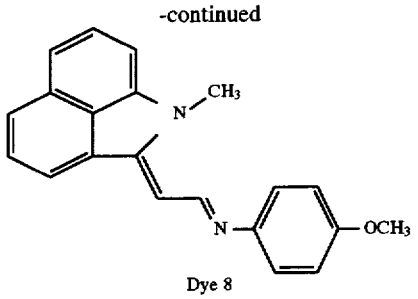

Dye 8
yellow (magenta)
U.S. Pat. No. 5,559,076 (dye precursor 5)

The dyes described above may be employed in any amount effective for the intended purpose. In general, good results have been obtained when the dye is present in an amount of from about 0.05 to about 1.0 g/m$^2$, preferably from about 0.1 to about 0.5 g/m$^2$. Dye mixtures may also be used.

It has been found that the receiver element which contains a polymer having a Tg of less than about 9° C. and being of no or only slight acidity and a hydrated transition metal or metalloid salt of a strong acid shows an improved rate of dye protonation (% dye conversion).

The hydrated transition metal or metalloid salt of a strong acid useful in the invention include various hydrated forms of the following transition metal or metalloid salts: aluminum sulfate, aluminum nitrate, aluminum chloride, potassium aluminum sulfate (alum), zinc sulfate, zinc nitrate, zinc chloride, nickel sulfate, nickel nitrate, nickel chloride, ferric sulfate, ferric chloride, ferric nitrate, cupric sulfate, cupric chloride, cupric nitrate, antimony (III) chloride, cobalt (II) chloride, ferrous sulfate, stannic chloride, aluminum trichloroacetate, zinc bromide, aluminum tosylate, zirconium (IV) chloride, etc. Mixtures of the above salts and complex salts thereof may also be used. In a preferred embodiment of the invention, the following hydrated transition metal and metalloid salts of a strong acid may be used: $Al_2(SO_4)_3.18H_2O$, $AlK(SO_4)_2.12H_2O$, $NiSO_4.6H_2O$, $ZnSO_4.7H_2O$, $CuSO_4.5H_2O$, $Fe_2(SO_4)_3.4H_2O$, $Al(NO_3)_3.9H_2O$, $Ni(NO_3)_2.6H_2O$, $Zn(NO_3)_2.6H_2O$, $Fe(NO_3)_3.9H_2O$ or $AlCl_3.6H_2O$.

Any amount of hydrated transition metal or metalloid salt of a strong acid can be used in the receiver as long as it is sufficient to fully protonate the dyes transferred to the receiver. In general, good results have been obtained when the hydrated transition metal or metalloid salt of a strong acid is employed at a concentration of from about 0.05 to about 1.5 g/m$^2$, preferably from about 0.1 to about 0.8 g/m$^2$.

The polymer having a Tg of less than about 19° C. employed in the invention may contain groups which are slightly acidic to improve water dispersibility. However, these acid groups are generally insufficient to protonate the dye.

Any type of polymer may be employed in the receiver of the invention, e.g., condensation polymers such as polyesters, polyurethanes, polycarbonates, etc.; addition polymers such as polystyrenes, vinyl polymers, acrylic polymers, etc.; block copolymers containing large segments of more than one type of polymer covalently linked together, provided such polymeric material has the low Tg as described above. In a preferred embodiment of the invention, the dye image-receiving layer comprises an acrylic polymer, a styrene polymer or a vinyl polymer.

Following are examples of polymers that may be used in the invention:

Polymer P-1: poly(butyl acrylate-co-allyl methacrylate) 98:2 wt core/poly(glycidyl methacrylate) 10 wt shell, (Tg=–40° C.)

Polymer P-2: poly(butyl acrylate-co-allyl methacrylate-co-2-acrylamido-2-methylpropanesulfonic acid sodium salt) 93:2:5 wt core/poly(glycidyl methacrylate) 10 wt shell, (Tg=–40° C.)

Polymer P-3: poly(butyl acrylate-co-allyl methacrylate-co-2-hydroxyethyl methacrylate-co-2-acrylamido-2-methylpropanesulfonic acid sodium salt) 83:2:10:5 wt core/poly(glycidyl methacrylate) 10 wt shell, (Tg=–33° C.)

Polymer P-4: poly(butyl acrylate-co-allyl methacrylate-co-2-hydroxyethyl methacrylate-co-2-acrylamido-2-methylpropanesulfonic acid sodium salt) 73:2:20:5 wt core/poly(glycidyl methacrylate) 10 wt shell, (Tg=–26° C.)

Polymer P-5: poly(methyl methacrylate-co-butyl acrylate-co-2-hydroxyethyl methacrylate-co-2-sulfoethyl methacrylate sodium salt) 20:60:10:10 wt, (Tg=–21° C.)

Polymer P-6: poly(ethyl acrylate-co-allyl methacrylate-co-2-acrylamido-2-methylpropanesulfonic acid sodium salt) 93:2:5 wt core/poly(glycidyl methacrylate) 10 wt shell, (Tg=–9° C.)

Polymer P-7: poly(methyl methacrylate-co-butyl acrylate-co-2-hydroxyethyl methacrylate-co-2-sulfoethyl methacrylate sodium salt) 30:50:10:10 wt, (Tg=–3° C.)

Polymer P-8: poly(butyl acrylate-co-allyl methacrylate) 98:2 wt core/poly(glycidyl methacrylate) 10 wt shell, (Tg=–40° C.)

Polymer P-9: poly(butyl acrylate-co-allyl methacrylate) 98:2 wt core/poly(ethyl methacrylate) 30 wt shell, (Tg=–41° C.)

Polymer P-10: poly(butyl acrylate-co-allyl methacrylate) 98:2 wt core/poly(2-hydroxypropyl methacrylate) 10 wt shell, (Tg=–40° C.)

Polymer P-11: poly(butyl acrylate-co-ethyleneglycol dimethacrylate) 98:2 wt core/poly(glycidyl methacrylate 10 wt shell, Tg=–42° C.)

Polymer P-12: poly(butyl acrylate-co-allyl methacrylate-co-glycidyl methacrylate) 89:2:9 wt, (Tg=–34° C.)

Polymer P-13: poly(butyl acrylate-co-ethyleneglycol dimethacrylate-co-glycidyl methacrylate) 89:2:9 wt (Tg=–28° C.)

Polymer P-14: poly(butyl methacrylate-co-butyl acrylate-co-allyl methacrylate) 49:49:2 wt core/poly(glycidyl methacrylate) 10 wt shell, (Tg=–18° C.)

Polymer P-15: poly(methyl methacrylate-co-butyl acrylate-co-2-hydroxyethyl methacrylate-co-styrenesulfonic acid sodium salt) 40:40:10:10 wt, (Tg=0° C.)

Polymer P-16: poly(methyl methacrylate-co-butyl acrylate-co-2-sulfoethyl methacrylate sodium salt-co-ethyleneglycol dimethacrylate) 44:44:10:2 wt, (Tg =14° C.)

Polymer P-17: poly(butyl acrylate-co-Zonyl TM®-co-2-acrylamido-2-methyl-propanesulfonic acid sodium salt) 50:45:5 wt (Tg=–39° C.) (Zonyl TM® is a monomer from the DuPont Company)

The polymer having a Tg of less than about 9° C. and being of no or only slight acidity employed in the dye image-receiving layer may be present in any amount which is effective for its intended purpose. In general, good results have been obtained at a concentration of from about 0.5 to about 10 g/m$^2$. The polymers may be coated from organic solvents or water, if desired.

The support for the dye-receiving element employed in the invention may be transparent or reflective, and may comprise a polymeric, synthetic or, cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Any material can be used as the support for the dye-donor element employed in the invention, provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 μm.

Dye-donor elements used in the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U. S. Pat. No. 4,700,207; or a poly (vinyl acetal) such as poly(vinyl alcohol-co-butyral). The binder may be used at a coverage of from about 0.1 to about 5 $g/m^2$.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of at least one of the dyes, as described above, capable of generating a cyan, magenta or yellow dye image and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB 2,083,726A.

When a three-color image is to be obtained, the assemblage described above is formed on three occasions during the time when heat is applied by the thermal printing head. After the first dye is transferred, the elements are peeled apart A second dye-donor element (or another area of the donor element with a different dye area) is then brought in register with the dye-receiving element and the process repeated. The third color is obtained in the same manner. After thermal dye transfer, the dye image-receiving layer contains a thermally-transferred dye image.

The following example is provided to further illustrate the invention.

EXAMPLE

The following control polymers were used to prepare dye-receiving elements:

Control Polymers

Polymer CP-1: poly(methyl methacrylate-co-butyl acrylate-co-2-hydroxyethyl methacrylate-co-2-sulfoethyl methacrylate sodium salt) 40:40:10:10 wt, (Tg=9° C.)

Polymer CP-2: poly(methyl methacrylate-co-butyl acrylate-co-2-hydroxyethyl methacrylate-co-2-sulfoethyl methacrylate sodium salt) 30:40:20:10 wt, (Tg=9° C.)

Polymer CP-3: poly(methyl metha-crylate-co-butyl acrylate-co-2-sulfoethyl methacrylate sodium salt) 50:40:10 wt, (Tg=13° C.)

Polymer CP-4: poly(methyl methacrylate-co-butyl acrylate-co-2-hydroxyethyl methacrylate-co-2-sulfoethyl methacrylate sodium salt) 30:30:30:10 wt, (Tg=19° C.)

Polymer CP-5: poly(methyl methacrylate-co-butyl acrylate-co-2-hydroxyethyl methacrylate-co-2-sulfoethyl methacrylate sodium salt) 50:30:10:10 wt, (Tg=26° C.)

Preparation of Dye-Donor Elements

Individual dye-donor elements were prepared by coating the following compositions in the order listed on a 6 μm polyethylene terephthalate) support:

1) a subbing layer of Tyzor TBT®, a titanium tetrabutoxide, (DuPont Company) (0. 13 $g/m^2$) coated from 1 -butanolpropyl acetate (15/85); and 2) an imaging dye layer coated from a tetrahydrofuran/cylopentanone (95/5) solvent mixture, whereby two different binder polymer mixtures with the selected dye as shown in Table 1 were used:

DB-1 propionate ester of bisphenol A copolymer with epichlorohydrin (prepared by techniques similar to those described in U.S. Pat. No. 5,244,862);

DB-2 poly(butyl methacrylate-co-Zonyl TM®) (75/25) where Zonyl TM® is a perfluoro monomer available from DuPont.

Details of dye and binder laydowns are summarized in the following Table 1:

TABLE 1

| Dye-Doner Element | Deprotonated Dye | Dye Laydown, ($g/m^2$) | DB-1 Laydown, ($g/m^2$) | DB-2 Laydown, ($g/m^2$) |
|---|---|---|---|---|
| Yellow | Dye 5 | 0.28 | 0.27 | 0.07 |
| Cyan | Dye 1 | 0.15 | 0.17 | 0.06 |

On the back side of the dye-donor element were coated the following compositions in the order listed:

1) a subbing layer of Tyzor TBT®, a titanium tetrabutoxide, (DuPont Company) (0.13 $g/m^2$) coated from 1-butanol; and
2) a slipping layer of 0.38 $g/m^2$ poly(vinyl acetal) (Sekisui), 0.022 $g/m^2$ Candelilla wax dispersion (7% in methanol), 0.011 $g/m^2$ PS513 amino-terminated polydimethylsiloxane (Huels) and 0.0003 $g/m^2$ p-toluenesulfonic acid coated from a 3-pentanone/distilled water (98/2) solvent mixture.

Preparation of Control Dye-Receiver Elements C-1 through C-8

Dye-receiver elements described below were prepared by coating a subbing layer and a dye image-receiving layer on a paper support which was extrusion laminated with a 38 μm thick microvoided composite film (OPPalyte® 350TW, Mobil Chemical Co.) as disclosed in U.S. Pat. No. 5,244,861.

Control Receiver Element C-1

This element was prepared by coating on the support the following layers in the order recited:

1) a subbing layer of 0.02 $g/m^2$ Polymin P® polyethyleneimine (BASF) coated from distilled water; and
2) a dye-receiving layer composed of a mixture of 4.00 $g/m^2$ Vylon® 200 polyester Toyobo Company Ltd.), 0.39 $g/m^2$ ethyl acetoacetate aluminum diisopropylate and 1.0 $g/m^2$ fumed silica (Cab-o-sil®, Cabot Corporation), coated from 2-butanone. This composition was analogous to Example 1 in U.S. Pat. No. 4,668,560.

Control Receiver Element C-2

This element was prepared the same as C-1, except the dye-receiving layer did not contain the fumed silica.

Control Receiver Element C-3

This element was prepared the same as C-1, except that the subbing layer was Prosil® 221 (0.05 $g/m^2$) and Prosil® 2210 (0.05 $g/m^2$) (PCR, Inc.) coated from 3A alcohol; and the dye image-receiving layer was a mixture of 2.69 $g/m^2$ poly[isophthalic acid-co-5-sulfoisophthalic acid (90:10 molar ratio) -diethylene glycol (100 molar ratio)], Mw=20,000 (sulfonic acid of AQ29, Eastman Chemical Co.), 4.04 $g/m^2$ of polymer P-1, and 0.022 $g/m^2$ of a fluorocarbon surfactant (Fluorad ® FC-170, 3M Corporation), coated from distilled water. This composition was analogous to Receiver Elements 7 through 18 in Example 1 of U.S. Pat. No. 5,627,128.

Control Receiver Elements C-4 through C-8

These elements were prepared the same as C-1, except that the dye image-receiving layer was a mixture of 0.59 $g/m^2$ of Aluminum sulfate, 18-Hydrate ($Al_2(SO_4)_3$), MW=666.45, Eastman Chemicals® Chem #07954, and 6.14 $g/m^2$ of control polymers CP-1 through CP-5 coated from distilled water.

Receiver Elements 1 through 7 of the Invention

Receiver Elements 1 through 7 of the invention were prepared as described above for Control Receiver Elements C-4 through C-8, except that the polymers used were polymers P-1 through P-7. A summary of receiver elements containing polymers P-1 through P-7 and control polymers C-4 through C-8 and corresponding Tg's is shown in Table 2 below.

TABLE 2

| Receiver Element | Polymer | Tg of Polymer, °C. |
|---|---|---|
| 1 | P-1 | −40° C. |
| 2 | P-2 | −40° C. |
| 3 | P-3 | −33° C. |
| 4 | P-4 | −26° C. |
| 5 | P-5 | −21° C. |
| 6 | P-6 | −9° C. |
| 7 | P-7 | −3° C. |
| C-4 | CP-1 | −9° C. |
| C-5 | CP-2 | −9° C. |
| C-6 | CP-3 | −13° C. |
| C-7 | CP-4 | −19° C. |
| C-8 | CP-5 | −26° C. |

Preparation and Evaluation of Thermal Dye Transfer Images

Eleven-step sensitometric cyan and green (yellow+cyan) thermal dye transfer images were prepared from the above dye-donor and dye-receiver elements. The dye side of the dye-donor element approximately 10 cm×15 cm in area was placed in contact with a receiving-layer side of a dye-receiving element of the same area. Assemblage was clamped to a stepper motor-driven, 60 mm diameter rubber roller. A thermal head (TDK model No. 8I0625 thermostatted at 25° C. was pressed with a force of 24.4 Newton (2.5 kg) against the dye donor element side of the assemblage, pushing it against the rubber roller.

The imaging electronics were activated causing the donor-receiver assemblage to be drawn through the print head/roller nip at 40.3 mm/sec. Coincidently, the resistive elements in the thermal print head were pulsed for 127.75 μs/pulse at 130.75 μs intervals during a 4.575 msec/dot printing cycle (including a 0.391 msec/dot cool-down interval). A stepped image density was generated by incrementally increasing the number of pulses/dot from a minimum of 0 to maximum of 32 pulses/dot. The voltage supplied to the thermal head was approximately 12.5 v resulting in an instantaneous peak power of 0.294 watts/dot and a maximum total energy of 1.20 mJ/dot. This procedure was done using the yellow dye-donor element and then repeated on a portion of the yellow image with the cyan dye-donor element to produce a green stepped image. Print room humidity: 61% RH.

For images containing a cyan dye (cyan or green images), the rate of protonation is proportional to the rate of color change from the deprotonated dye form (magenta) to the protonated dye form (cyan). This color change can be monitored by measuring Status A red (cyan) and green (magenta) densities at various time intervals and calculating the red/green ratio for each time interval. Complete protonation (conversion) of the cyan dye was equivalent to the red/green ratio after incubating prints at 50° C./50% RH for 3 hours, and the percentage of dye conversion was calculated.

After printing, the dye-donor element was separated from the imaged receiving element and the Status A reflection red and green densities at step 10 in the stepped-image were measured for the green image using an X-Rite 820® Reflection Densitometer after 5.0 minutes at room temperature. The prints were then placed into a 50° C./50% RH oven for 3.0 hours and the red and green densities were reread. A red/green (R/G) ratio (minus the baseline) was calculated for the cyan dye in the green image in each receiver at the above mentioned time intervals and the % dye conversion for the cyan dye in the green image was calculated assuming the incubated R/G ratios represented 100% dye conversion. The results are summarized in the following Table 3:

TABLE 3

| Receiver Element | R/G Ratio 5 minutes r.t.[1] | R/G Ratio 3 hours incubated[2] | % Dye Conversion, 5 minutes[3] |
|---|---|---|---|
| 1 | 3.31 | 4.29 | 77% |
| 2 | 3.83 | 4.51 | 85% |
| 3 | 3.21 | 4.22 | 76% |
| 4 | 2.90 | 4.63 | 63% |
| 5 | 2.78 | 4.34 | 64% |
| 6 | 1.64 | 4.10 | 40% |
| 7 | 1.72 | 4.13 | 42% |
| C-1[4] | — | — | — |
| C-2 | 0.26 | 0.32 | no data[5] |
| C-3 | 1.82 | 5.48 | 33% |
| C-4 | 1.05 | 3.83 | 27% |
| C-5 | 1.20 | 4.06 | 30% |
| C-6 | .97 | 3.69 | 26% |
| C-7 | .99 | 3.68 | 27% |
| C-8 | .97 | 3.50 | 28% |

[1]calculated red/green ratio for green image after 5 minutes at room temperature
[2]calculated red/green ratio for green image after 3 hours at 50° C./50% RH
[3](R/G Ratio, 5 minutes r.t.)/(R/G Ratio, 3 hours, incubated) × 100 for green image
[4]very low print density was obtained and no % dye conversion could be determined
[5]good print density was obtained but dyes did not reprotonate after incubation The above results show that mixing a hydrated transition metal salt of strong acid and a polymer having a Tg of less than 9° C. and being of no or only slightly improved the rate of protonation (dye conversion) of deprotonated cationic dyes after printing (receiver elements 1–7) as compared to receiver mixtures containing an organic polymeric or oligomeric sulfonic acid (C-3). Mixing polymers having a Tg greater than 9° C. with a hydrated transition metal salt of a strong acid (C-4 through C-8) showed no advantage over mixtures containing an organic polymeric or oligomeric sulfonic acid (C-3).

The invention has been described in detail with particular reference to preferred embodiments thereof, but it will be understood that variations and modifications can be effected within the spirit and scope of the invention.

What is claimed is:

1. A thermal dye transfer assemblage comprising:

(I) a dye-donor element comprising a support having thereon sequentially repeating dye layer patches of a dye dispersed in a polymeric binder, at least one of said dye patches containing a deprotonated cationic dye which is capable of being reprotonated to a cationic dye having a N-H group which is part of a conjugated system; and (II) a dye-receiving element comprising a support having thereon a polymeric dye image-receiving layer comprising a polymer having a Tg of less than about 9° C. and being of no or only slight acidity and a hydrated transition metal or metalloid salt of a strong acid, said dye-receiving element being in a superposed relationship with said dye-donor element so that said dye layer is in contact with said polymeric dye image-receiving layer.

2. The assemblage of claim 1 wherein said polymer having a Tg of less than about 90° C. and being of no or only slight acidity comprises an acrylic polymer, a styrene polymer or a vinyl polymer.

3. The assemblage of claim 2 wherein said polymer having a Tg of less than about 9° C. and being of no or only slight acidity comprises poly(butyl acrylate-co-allyl methacrylate) 98:2 wt core/poly(glycidyl methacrylate) 10 wt shell; poly(butyl acrylate-co-allyl methacrylate-co-2-acrylamido-2-methylpropanesulfonic acid sodium salt) 93:2:5 wt core/poly(glycidyl methacrylate) 10 wt shell; poly(butyl acrylate-co-allyl methacrylate-co-2-hydroxyethyl methacrylate-co-2-acrylamido-2-methylpropanesulfonic acid sodium salt) 83:2:10:5 wt core/poly(glycidyl methacrylate) 10 wt shell; poly(butyl acrylate-co-allyl methacrylate-co-2-hydroxyethyl methacrylate-co-2-acrylamido-2-methylpropanesulfonic acid sodium salt) 73:2:20:5 wt core/poly(glycidyl methacrylate) 10 wt shell; poly(methyl methacrylate-co-butyl acrylate-co-2-hydroxyethyl methacrylate-co-2-sulfoethyl methacrylate sodium salt) 20:60:10:10 wt; poly(ethyl acrylate-co-allyl methacrylate-co-2-acrylamido-2-methylpropanesulfonic acid sodium salt) 93:2:5 wt core/poly(glycidyl methacrylate) 10 wt shell; or poly(methyl methacrylate-co-butyl acrylate-co-2-hydroxyethyl methacrylate-co-2-sulfoethyl methacrylate sodium salt) 30:50:10:10 wt.

4. The assemblage of claim 1 wherein said hydrated transition metal or metalloid salt of a strong acid is a hydrated form of: aluminum sulfate, aluminum nitrate, aluminum chloride, potassium aluminum sulfate, zinc sulfate, zinc nitrate, zinc chloride, nickel sulfate, nickel nitrate, nickel chloride, ferric sulfate, ferric chloride, ferric nitrate, cupric sulfate, cupric chloride, cupric nitrate, antimony (III) chloride, cobalt (II) chloride, ferrous sulfate, stannic chloride, aluminum trichloroacetate, zinc bromide, aluminum tosylate, or zirconium (IV) chloride.

5. The assemblage of claim 1 wherein said receiving layer contains $Al_2(SO_4)_3 \cdot 18H_2O$, $AlK(SO_4)_2 \cdot 12H_2O$, $NiSO_4 \cdot 6H_2O$, $ZnSO_4 \cdot 7H_2O$, $CuSO_4 \cdot 5H_2O$, $Fe_2(SO_4)_3 \cdot 4H_2O$, $Al(NO_3)_3 \cdot 9H_2O$, $Ni(NO_3)_2 \cdot 6H_2O$, $Zn(NO_3)_2 \cdot 6H_2O$, $Fe(NO_3)_3 \cdot 9H_2O$ or $AlCl_3 \cdot 6H_2O$.

6. The assemblage of claim 1 wherein said hydrated transition metal or metalloid salt of a strong acid is employed at a concentration of from about 0.05 to about 1.5 $g/m^2$.

7. A process of forming a dye transfer image comprising imagewise-heating a dye-donor element comprising a support having thereon a dye layer comprising a dye dispersed in a polymeric binder, and imagewise transferring said dye to a dye-receiving element to form said dye transfer image, wherein said dye-donor element comprises a support having thereon sequentially repeating dye layer patches of a dye dispersed in a polymeric binder, at least one of said dye patches containing a deprotonated cationic dye which is capable of being reprotonated to a cationic dye having a N-H group which is part of a conjugated system; and said dye-receiving element comprises a support having thereon a polymeric dye image-receiving layer comprising a polymer having a Tg of less than about 9° C. and being of no or only slight acidity and a hydrated transition metal or metalloid salt of a strong acid.

8. The process of claim 7 wherein said polymer having a Tg of less than about 90° C. and being of no or only slight acidity comprises an acrylic polymer, a styrene polymer or a vinyl polymer.

9. The process of claim 8 wherein said polymer having a Tg of less than about 9° C. and being of no or only slight acidity comprises poly(butyl acrylate-co-allyl methacrylate) 98:2 wt core/poly(glycidyl methacrylate) 10 wt shell; poly (butyl acrylate-co-allyl methacrylate-co-2-acrylamido-2-methylpropanesulfonic acid sodium salt) 93:2:5 wt core/poly(glycidyl methacrylate) 10 wt shell; poly(butyl acrylate-co-allyl methacrylate-co-2-hydroxyethyl methacrylate-co-2-acrylamido-2-methylpropanesulfonic acid sodium salt) 83:2:10:5 wt core/poly(glycidyl methacrylate) 10 wt shell; poly(butyl acrylate-co-allyl methacrylate-co-2-hydroxyethyl methacrylate-co-2-acrylamido-2-methylpropanesulfonic acid sodium salt) 73:2:20:5 wt core/poly(glycidyl methacrylate) 10 wt shell; poly(methyl methacrylate-co-butyl acrylate-co-2-hydroxyethyl methacrylate-co-2-sulfoethyl methacrylate sodium salt) 20:60:10:10 wt; poly(ethyl acrylate-co-allyl methacrylate-co-2-acrylamido-2-methylpropanesulfonic acid sodium salt) 93:2:5 wt core/poly(glycidyl methacrylate) 10 wt shell; or poly(methyl methacrylate-co-butyl acrylate-co-2-hydroxyethyl methacrylate-co-2-sulfoethyl methacrylate sodium salt) 30:50:10:10 wt.

10. The process of claim 7 wherein said hydrated transition metal or metalloid salt of a strong acid is a hydrated form of: aluminum sulfate, aluminum nitrate, aluminum chloride, potassium aluminum sulfate, zinc sulfate, zinc nitrate, zink chloride, nickel sulfate, nickel nitrate, nickel chloride, ferric sulfate, ferric chloride, ferric nitrate, cupric sulfate, cupric chloride, cupric nitrate, antimony (III) chloride, cobalt (II) chloride, ferrous sulfate, stannic chloride, aluminum trichloroacetate, zinc bromide, aluminum tosylate, or zirconium (IV) chloride.

11. The process of claim 7 wherein said receiving layer contains $Al_2(SO_4)_3 \cdot 18H_2O$, $AlK(SO_4)_2 \cdot 12H_2O$, $NiSO_4 \cdot 6H_2O$, $ZnSO_4 \cdot 7H_2O$, $CuSO_4 \cdot 5H_2O$, $Fe_2(SO_4)_3 \cdot 4H_2O$, $Al(NO_3)_3 \cdot 9H_2O$, $Ni(NO_3)_2 \cdot 6H_2O$, $Zn(NO_3)_2 \cdot 6H_2O$, $Fe(NO_3)_3 \cdot 9H_2O$ or $AlCl_3 \cdot 6H_2O$.

12. The process of claim 7 wherein said hydrated transition metal or metalloid salt of a strong acid is employed at a concentration of from about 0.05 to about 1.5 $g/m^2$.

* * * * *

UNITED STATES PATENT AND TRADEMARK OFFICE

CERTIFICATE OF CORRECTION

PATENT NO. : 5,786,300
DATED : July 28, 1998
INVENTOR(S) : Wayne A. Bowman, et al It is certified that error appears in the above-identified patent and that said Letters Patent is hereby corrected as shown below:

Claim 2, col. 12, line 2 -- "9° C" --
Claim 8, col. 12, line 63 -- "9° C " --

Signed and Sealed this
Twelfth Day of January, 1999

*Attest:*

*Attesting Officer*

*Acting Commissioner of Patents and Trademarks*